US005463194A

United States Patent [19]

Ransom et al.

[11] Patent Number: 5,463,194

[45] Date of Patent: Oct. 31, 1995

[54] EXHAUST SYSTEM

[75] Inventors: Keith C. Ransom, South Benfleet; Michael J. Southwell, Chelmsford, both of United Kingdom

[73] Assignee: Ford Motor Company, Dearborn, Mich.

[21] Appl. No.: 856,143

[22] PCT Filed: Nov. 8, 1990

[86] PCT No.: PCT/GB90/01715

§ 371 Date: Mar. 27, 1992

§ 102(e) Date: Mar. 27, 1992

[87] PCT Pub. No.: WO91/07576

PCT Pub. Date: May 30, 1991

[30] Foreign Application Priority Data

Nov. 15, 1989 [GB] United Kingdom ..... 8925842

[51] Int. Cl.[6] ..... F01N 7/10; F16L 27/04

[52] U.S. Cl. ..... 181/240; 285/268

[58] Field of Search ..... 181/208, 209, 181/238, 239, 240; 60/313, 323; 285/62, 94, 166, 264, 268, 412

[56] References Cited

U.S. PATENT DOCUMENTS 4,182,121 1/1980 Hall ..... 60/313

4,188,784 2/1980 Hall ..... 60/323

4,516,782 5/1985 Usher ..... 285/412 X 4,856,822 8/1989 Parker ..... 285/62

*Primary Examiner*—Khanh Dang

*Attorney, Agent, or Firm*—Jerome R. Drouillard; Roger L. May

[57] ABSTRACT

An exhaust system for a motor vehicle internal combustion engine is described in which the lower end of the exhaust manifold (10) and the upper end of the down pipe (**12*a*, 12*b*) each comprise two or more conduits which are sector shaped in cross section and are arranged to form a complete circle split by radial walls. The circumference of the down pipe is sealed by a flexible ball joint (14) against the circumference of the manifold (10) and the radial walls (16*c*) of the down pipe (12*a*, 12*b*) are spaced from the radial walls (10*a*) of the manifold by a small gap sufficient to permit pivoting of the down pipe relative to the manifold. The down pipe (12*a*, 12*b*) is urged against the manifold (10) by clamping bolts (20**) the heads of which are pivotable relative to the exhaust system about an axis passing through the pivotal center of the flexible ball joint.

1 Claim, 1 Drawing Sheet

EXHAUST SYSTEM

FIELD OF THE INVENTION

The present invention relates to an exhaust system and in particular to the joint in an internal combustion engine between the exhaust manifold and the down pipe.

BACKGROUND OF THE INVENTION

The engine of a motor vehicle is supported on flexible engine mounts and can rock during operation. Because of the mass of the exhaust pipe and the manner of its mounting on the vehicle body, rocking of the engine gives rise to significant stresses in the exhaust system which reduce the life of the system.

In order to assist in isolating the exhaust system from the rocking of the engine, flexible ball joints have been proposed for use at the junction between two pipe sections. The term "flexible ball joint" is used in the present specification to a refer to a joint having a collar with a part-spherical surface which seals between a flange on one of the pipe sections and a part-spherical seat on the other, the joint allowing the pipe sections to pivot relative to one another without any escape of exhaust gases.

Such a joint has been used at the lower end of the down pipe, but there it is far removed from the rocking axis of the engine. The length of the down pipe exaggerates the rocking and introduces considerable side to side movement, which cannot be accommodated by a single flexible ball joint.

It has also been proposed to use a flexible ball joint at the top end of the down pipe, where it joins on to the exhaust manifold. In this case, the down pipe has but a single conduit and it is not possible to tune the length of the branches of the exhaust manifold to enhance scavenging.

GB-A-1 586 244 describes an exhaust system for a motor vehicle internal combustion engine, in which the lower end of the exhaust manifold and the upper end of the down pipe each comprise two conduits which are sector shaped in cross section and are arranged to form a complete circle split by radial walls. The circumference of the down pipe is sealed by a flexible ball joint against the circumference of the manifold and the radial walls of the down pipe are spaced from the radial walls of the manifold by a small gap sufficient to permit pivoting of the down pipe relative to the manifold.

Though this exhaust system is capable of permitting the engine to rock relative to the down pipe, the construction and design of the clamping bolts which hold the parts of the flexible ball joint against one another interfere with the operation of the ball joint and are a source of squeaks.

OBJECT OF THE INVENTION

The invention therefore seeks to provide an exhaust system in which a flexible ball joint is provided to enable the engine to rock relative to exhaust down pipe but in which the flexible ball joint is held together by clamping bolts which do not interfere with the function of the ball joint and do not squeak in operation.

SUMMARY OF THE INVENTION

According to the present invention, there is provided an exhaust system for a motor vehicle internal combustion engine, in which the lower end of the exhaust manifold and the upper end of the down pipe each comprise two or more conduits which are sector shaped in cross section and are arranged to form a complete circle split by radial walls, and wherein the circumference of the down pipe is sealed by a flexible ball joint against the circumference of the manifold and the radial walls of the down pipe are spaced from the radial walls of the manifold by a small gap sufficient to permit pivoting of the down pipe relative to the manifold, characterised in that the down pipe is urged against the manifold by clamping bolts the heads of which are pivotable relative to the manifold about an axis passing through the pivotal centre of the flexible ball joint.

Conveniently, the exhaust manifold and the down pipe are divided into only two conduits by a partition wall extending along a diameter of the flexible ball joint.

A further problem found with the proposal of GB-1 586 244 is that the pivotal centre of the flexible ball joint is far removed from the roll centre of the engine. The roll centre is usually designed to lie above the joint between the manifold of the down pipe and in the above prior art patent the pivotal centre of the flexible ball joint lies beneath the joint.

In accordance with a preferred feature of the present invention, the flexible ball joint is formed by a concave part-spherical seat formed on ah attachment secured to the down pipe and convex surface on a sealing collar mounted on the manifold. Because the flexible ball joint is made concave upwards, instead of concave downwards, its pivotal centre is brought closer to the roll centre of the engine.

BRIEF DESCRIPTION OF THE DRAWING

The invention will now be described further, by way of example, with reference to the accompanying drawing which shows schematically the joint in an exhaust system of the invention between the manifold and the down pipe.

DESCRIPTION OF THE PREFERRED EMBODIMENT

Figure 1:
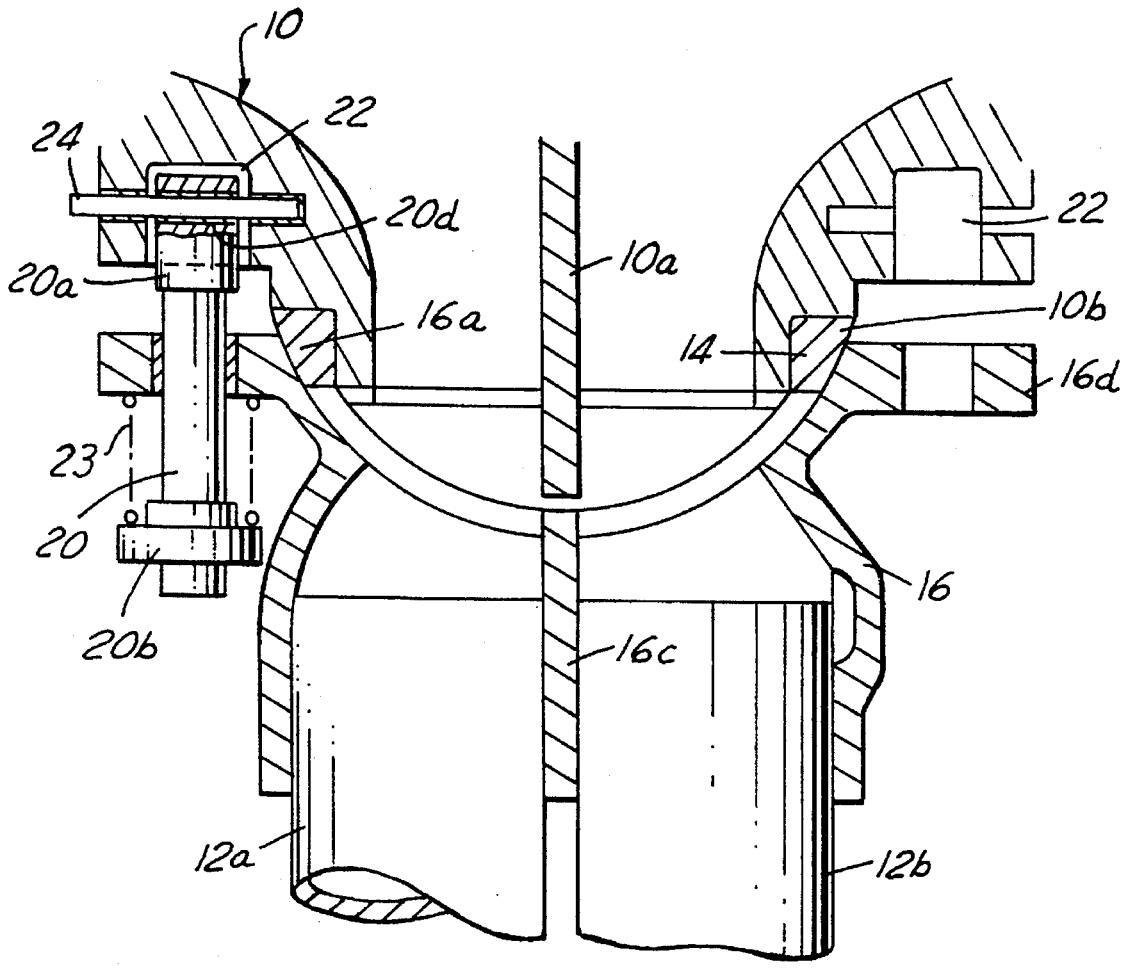

In the drawing, an exhaust manifold 10 is joined to a pair of down pipe conduits 12*a* and 12*b* by a flexible ball joint, described in more detail below, which is sealed by a collar 14. The two conduits 12*a* and 12*b* are brought together at their upper end within a stainless steel attachment 16. The attachment 16 has two sockets for receiving the conduits 12*a* and 12*b* which are D-shaped when view in plan and arranged back to back to define a full circle with a dividing wall 16*c* extending along a diameter.

The attachment 16 also has a flange 16*d* formed with holes for receiving clamping bolts 20 which hold the down pipe conduits 12*a* and 12*b* against the exhaust manifold 10.

The lower end of the manifold 10 when viewed from the direction of the down pipe is likewise divided into two by a diametrically extending dividing wall 10*a* aligned with the wall 16*c* of the attachment 16 and spaced from it by only a small clearance.

In a four cylinder engine, the exhaust gases from two of the cylinders, operating in anti-phases, will be directed to flow along one of the conduits while the gases from the other two cylinder flow along the other. The two gas flows do not meet until the lower ends of the conduits join one another. As in the case of an exhaust system with separate joints for two down pipes, the lengths of the exhaust pipes can be tuned in order to improve scavenging.

A single flexible ball joint secures both down pipe conduits 12*a* and 12*b* to the manifold 10. To this end, the manifold 10 has at its lower end a shoulder 10*b* against which there is seated the collar 14. The latter is formed of a slightly compressible material, preferably a wire mesh clad with a layer of copper. The collar 14 is compressed between the shoulder on the exhaust manifold and a part spherical seat 16*a* defined by the attachment 16 and maintains a gas tight seal while permitting the down pipe conduits 12*a* and 12*b* to pivot relative to the exhaust manifold 10 about the centre of the part-spherical seat 16a formed in the attachment 16.

The attachment 16 and the manifold 10 are resiliently held against one another by means of springs 23 fitted around the two clamping bolts 20. Each clamping bolt 20 has a head 20*a* which can be received in a blind bore 22 in the manifold. A steel pin 24 traverses the blind bore 22 and a through cross bore 20*d* in the head 20*a* to prevent withdrawal of the head 20*a* from the blind bore 22 and to define a pivot axis about which the attachment 16 may rock relative to the manifold. The aligned axes of the two pins 24 are arranged to lie on a central axis of the part spherical surface 16*a* at right angles to the partition walls 10*a* and 16*c*. This geometry of the clamping bolts 20 permits the joint to bend without any change in the length of the springs 24 which assists in maintaining the correct tension on the sealing collar 14 and in avoiding squeaks.

To assemble the flexible ball joint, it would be possible to tighten the nuts 20*b* on the bolts 20 after the heads 20*a* have been inserted into the manifold 10 and held in place by means of the pins 24. However, to ease and speed assembly, it is preferred to pre-assemble the bolts 20 and springs 24 on the attachment flange 16*d* and to hold the springs compressed by means of U-shaped clips (not shown) engaging between the flanges 16*d* and the heads 20*a* of the clamping bolts 20. After the heads 20*a* have been retained in the manifold by insertion of the pins 24, the clips can be withdrawn, leaving the springs correctly tensioned.

It is possible to arrange the axis of the pins 24 on or very close to the roll centre of the engine and this reduces significantly the stresses to which the exhaust pipe and the exhaust manifold are subjected while still permitting tuning of the lengths of the manifold branches.

In this context, it should be noted that the roll centre of an engine is usually designed to be higher than the joint between the manifold and the down pipe. For this reason, the flexible ball joint in the described preferred embodiment is convex downwards, that is towards the down pipe. In this way, the pivotal axis of the flexible ball joint lies on the manifold side of the ball joint and the heads of clamping bolts engage in the manifold 10 rather than the attachment 16.

Rocking of engine at right angles to the roll axis is also accommodated by the flexible ball joint in that the springs 20 can be individually compressed during such rocking motion.

It should be mentioned that other constructions of the clamping bolts are possible which permit the bolts to pivot relative to the exhaust system. For example, if the manifold is provided with a flange similar to the flange 16*d* of the attachment 16, then the heads of the bolts and the mating surfaces on the flange may be curved to allow the desired pivotal movement centre on the axis of the flexible ball joint.

We claim:

1. An exhaust system for a motor vehicle internal combustion engine, having an exhaust manifold with a lower end and a down pipe with an upper end, in which the lower end of the exhaust manifold (10) and the upper end of the down pipe (12*a*, 12*b*) each comprise two or more conduits which are sector shaped in cross section and wherein the down pipe is sealed against the manifold (10) by a ball joint having a pivotal centre and the down pipe (12*a*, 12*b*) is spaced from the radial walls (10*a*) of the manifold by a small gap sufficient to permit pivoting of the down pipe relative to the manifold, characterised in that the down pipe (12*a*, 12*b*) is urged against the manifold (10) by clamping bolts (20) having heads which are pivotable relative to the manifold about an axis passing through the pivotal centre of the flexible ball joint.

* * * * *